US009128463B2

(12) United States Patent
Conus et al.

(10) Patent No.: US 9,128,463 B2
(45) Date of Patent: Sep. 8, 2015

(54) ASSEMBLY OF A PART THAT HAS NO PLASTIC DOMAIN

(75) Inventors: Thierry Conus, Lengnau (CH); Marco Verardo, Les Bois (CH); Igor Saglini, Fenin (CH); Frederic Kohler, Villars-sur-Glane (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 215 days.

(21) Appl. No.: 13/995,052

(22) PCT Filed: Nov. 22, 2011

(86) PCT No.: PCT/EP2011/070693

§ 371 (c)(1),
(2), (4) Date: Jun. 17, 2013

(87) PCT Pub. No.: WO2012/084384

PCT Pub. Date: Jun. 28, 2012

(65) Prior Publication Data

US 2013/0286795 A1 Oct. 31, 2013

(30) Foreign Application Priority Data

Dec. 22, 2010 (EP) ..... 10196597

(51) Int. Cl.

| | |
|---|---|
| ***G04B 17/32*** | (2006.01) |
| ***G04B 15/14*** | (2006.01) |
| ***G04B 13/02*** | (2006.01) |
| ***G04D 3/04*** | (2006.01) |
| ***G04B 17/34*** | (2006.01) |
| ***G04D 1/00*** | (2006.01) |
| ***G04B 1/14*** | (2006.01) |

(52) U.S. Cl.

CPC ..... *G04B 13/02* (2013.01); *G04B 1/145* (2013.01); *G04B 13/022* (2013.01); *G04B 13/026* (2013.01); *G04B 15/14* (2013.01); *G04B 17/32* (2013.01); *G04B 17/325* (2013.01); *G04B17/345* (2013.01); *G04D 1/0042* (2013.01); *G04D 3/04* (2013.01); *Y10T 29/49581* (2015.01)

(58) Field of Classification Search

CPC ..... G04B 13/02; G04B 1/145; G04B 13/022; G04B 13/026; G04B 15/14; G04B 17/32; G04B 17/325; G04B 17/345; G04D 1/0042; G04D 3/04

See application file for complete search history.

(56) References Cited

U.S. PATENT DOCUMENTS 3,672,150 A * 6/1972 Yasuda et al. ..... 368/37
3,922,041 A * 11/1975 Quaile et al. ..... 368/324

(Continued)

FOREIGN PATENT DOCUMENTS

| | | | |
|---|---|---|---|
| CH | 700 260 | A2 | 7/2010 |
| EP | 1 850 193 | A1 | 10/2007 |
| EP | 2 442 189 | A1 | 4/2012 |

OTHER PUBLICATIONS

Machine translation of Swiss CH700260, retrieved from the internet Mar. 17, 2015.*

International Search Report Issued Jun. 5, 2012 in PCT/EP2011/070693 Filed Nov. 22, 2011.

*Primary Examiner* — Vit W Miska

(74) *Attorney, Agent, or Firm* — Oblon, McClelland, Maier & Neustadt, L.L.P.

(57) ABSTRACT

An assembly of an axially extending member, made of a first material, in an aperture of a part, made of a second material having no plastic domain. The part includes pierced holes forming an elastic deformation mechanism distributed around the aperture thereof. Further, the member includes an elastically and plastically deformed, radially flared portion that radially grips a wall of the part surrounding the aperture by stressing the elastic deformation mechanism, so as to secure the assembly in a manner that is not destructive for the part. The assembly can be used in the field of timepieces.

14 Claims, 4 Drawing Sheets

(56) References Cited

U.S. PATENT DOCUMENTS

| | | | | |
|---|---|---|---|---|
| 4,358,166 | A * | 11/1982 | Antoine | 384/215 |
| 7,926,355 | B2 * | 4/2011 | Bannier et al. | 73/760 |
| 8,206,029 | B2 * | 6/2012 | Vaucher et al. | 368/324 |
| 2003/0007706 | A1 * | 1/2003 | Suh et al. | 384/125 |
| 2006/0055097 | A1 * | 3/2006 | Conus et al. | 267/273 |
| 2008/0112274 | A1 * | 5/2008 | Bitterli et al. | 368/238 |
| 2009/0263182 | A1 * | 10/2009 | Bannier et al. | 403/242 |
| 2011/0005055 | A1 * | 1/2011 | Gigandet et al. | 29/428 |
| 2012/0090933 | A1 | 4/2012 | Conus et al. | |

* cited by examiner

ASSEMBLY OF A PART THAT HAS NO PLASTIC DOMAIN

CROSS-REFERENCE TO RELATED APPLICATIONS

This is a National Phase Application in the United States of International Patent Application PCT/EP2011/070693 filed Nov. 22, 2011, which claims priority on European Application No. 10196597.8 of Dec. 22, 2010. The entire disclosures of the above patent applications are hereby incorporated by reference.

FIELD OF THE INVENTION

The invention relates to the assembly of a part, made of a material having no plastic domain, to a member comprising a different type of material.

BACKGROUND OF THE INVENTION

Current assemblies including a silicon-based part are generally secured by bonding. This type of operation requires extremely delicate application which makes it expensive.

SUMMARY OF THE INVENTION

It is an object of the present invention to overcome all or part of the aforecited drawbacks by providing an adhesive-free assembly which can secure a part made of a material with no plastic domain to a member comprising a ductile material, such as, for example, a metal or metal alloy.

The invention therefore relates to an assembly of an axially extending member, made of a first material, in the aperture of a part made of a second material having no plastic domain, characterized in that the part includes pierced holes forming elastic deformation means distributed around the aperture therein and in that said member includes an elastically and plastically deformed, radially flared portion which radially grips or champs the wall of said part surrounding the aperture, by stressing said elastic deformation means to secure the assembly in a manner that is not destructive for said part.

This configuration advantageously enables the unit comprising the part-member to be secured without bonding to an ordinary, precision controlled member, while ensuring that the part is not subject to destructive stresses, even if is formed, for example, from silicon.

In accordance with other advantageous features of the invention:

- The shape of the flared portion substantially matches the aperture in the part so as to exert a substantially uniform radial stress on the wall of the part surrounding said aperture;
- The aperture in the part is circular;
- The aperture in the part is asymmetrical to prevent any relative movements between the elements of said assembly;
- The pierced holes are formed at a distance from and around the aperture by two series of diamond-shaped holes, distributed in a quincunx arrangement, so as to form beams arranged in secant V-shapes:
- The pierced holes include, between the first two series and the aperture, a third series which is formed of triangular holes and arranged in a quincunx arrangement with one of the first two series, so as to form beams distributed in secant X-shapes;

- The part includes slots allowing communication between the third series of holes and the aperture;
- The pierced holes are formed at a distance from and around the aperture by a first series of oblong holes distributed in a quincunx arrangement with a second series of triangular holes, wherein the second series is the closest to the aperture and each triangular hole communicates with the aperture via a notch, so as to form beams that are radially moveable according to the thickness of the oblong holes;
- The pierced holes include a third series of holes in a triangle, each hole of the third series being distributed between two triangular holes of the second series and communicating with the aperture via a slot, so as to form beams with two independent arms that are moveable radially according to the thickness of the oblong holes and tangentially according to the thickness of the slots;
- The series of holes extend over a width comprised between 100 μm and 500 μm from the wall of the part surrounding the aperture;
- The aperture has a section of between 0.5 and 2 mm.

Moreover, the invention relates to a timepiece, characterized in that it includes an assembly according to any of the preceding variants.

Finally, the invention relates to a method of assembling an axially extending member, made of a first material, in a part made of a second material having no plastic domain. The method includes the following steps:

a) Forming the part with an aperture and pierced holes distributed around the aperture intended to form elastic deformation means.
b) Inserting a radially flared portion of said member into the aperture, without any stress.
c) Elastically and plastically deforming the flared portion of said member in the aperture by moving two tools towards each other axially, respectively on the top and bottom parts of said flared portion, so as to exert a radial stress against the wall of the part surrounding the aperture, stressing said elastic deformation means of the part, in order to secure the assembly in a manner that is not destructive for said part.

This method advantageously allows the member to be radially secured without any axial stress being applied to the part. Indeed, advantageously according to the invention, only radial, elastic deformation is applied to the part. Finally, this method unites the assembly comprising the part-member by adapting to the dispersions in manufacture of the various components.

In accordance with other advantageous features of the invention:

- The shape of the external wall of the flared portion of said member in the aperture substantially matches the aperture in the part, so as to exert a substantially uniform radial stress on the wall of the part surrounding the aperture;
- The aperture in the part is circular;
- The aperture in the part is asymmetrical to prevent any relative movements between the elements of said assembly;
- In step b), the difference between the section of the circular aperture and the external section of the flared portion of said member in the aperture is around 10 μm;
- In step c), the deformation exerts a clamping force that generates a displacement of between 8 and 20 μm;
- In steps b) and c), the flared portion of the member in the aperture is held in the aperture by using one of the two tools;

The second material is silicon-based;

The first material is formed from a metal or metal alloy base;

The part may be, for example, a timepiece wheel set, timepiece pallets, a timepiece balance spring, a resonator or even a MEMS.

BRIEF DESCRIPTION OF THE DRAWINGS

Other features and advantages will appear clearly from the following description, given by way of non-limiting indication, with reference to the annexed drawings, in which.

DETAILED DESCRIPTION OF PREFERRED EMBODIMENTS

Figure 1:
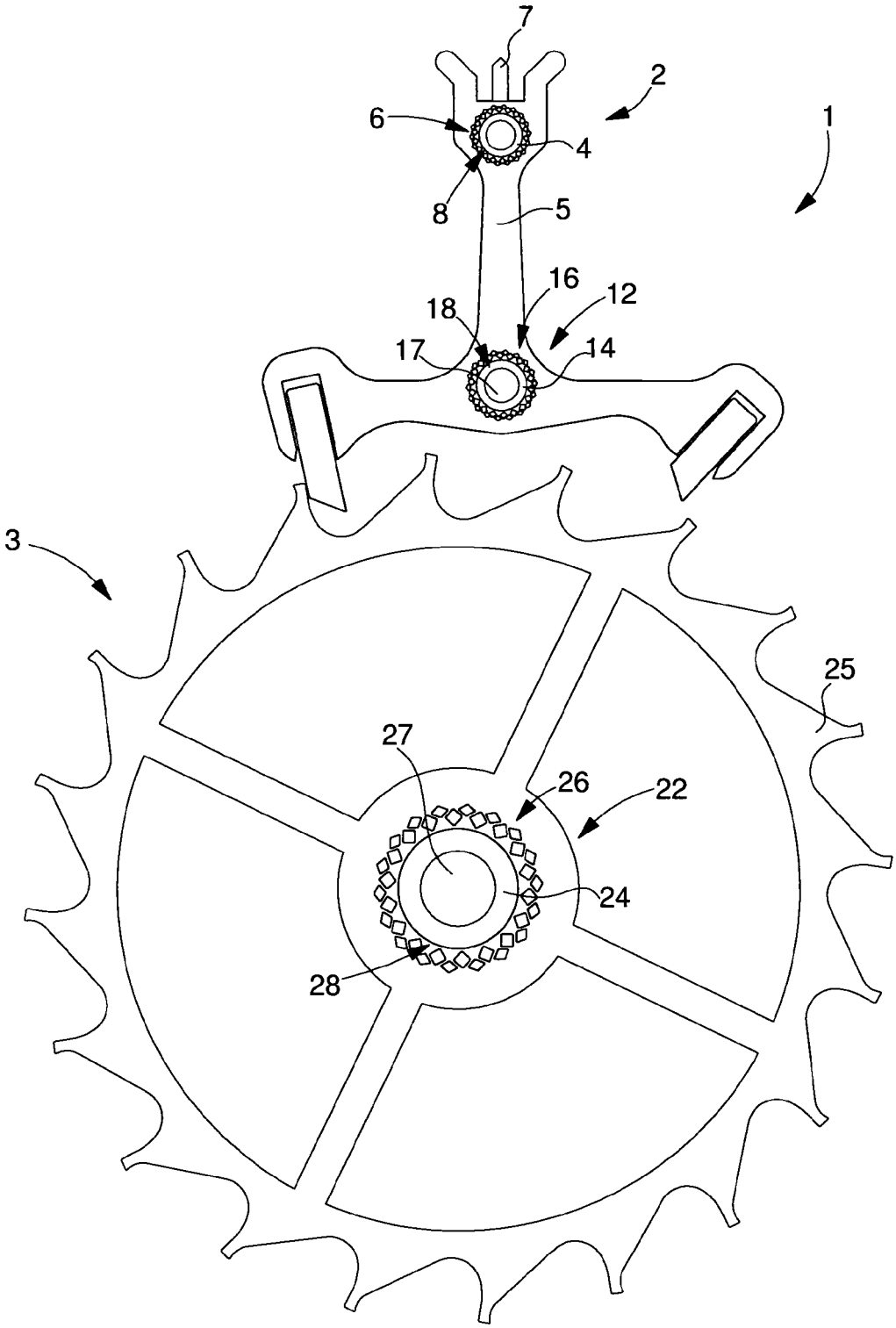
FIG. 1 is a partial, schematic view of a timepiece movement including three assemblies according to the invention.

As explained above, the invention relates to an assembly and the method of assembling the same, for uniting a fragile material, i.e. which has no plastic domain, such as a silicon-based material, with a ductile material such as a metal or metal alloy.

This assembly was devised for applications within the field of horology. However, other domains may very well be envisaged, such as, notably, aeronautics, jewelry, the automobile industry or tableware.

In the field of horology, this assembly is required due to the increasing importance of fragile materials, such as those based on silicon, quartz, corundum or more generally ceramics. By way of example, it is possible to envisage forming the balance spring, balance, pallets, bridges or even the wheel sets, such as the escape wheels, completely or partially from a base of fragile materials.

However, the constraint of always having to use ordinary steel arbours, the fabrication of which has been mastered, is difficult to reconcile with the use of parts having no plastic domain. Indeed, when tests were carried out, it was impossible to drive in a steel arbour and this systematically broke fragile parts, i.e. those with no plastic domain. For example, it became clear that the shearing generated by the entry of the metallic arbour into the aperture in a silicon part systematically breaks the part.

This is why the invention relates to the assembly of an axially extending member, made of a first material, for example a ductile material such as steel, in the aperture of a part made of a second material having no plastic domain, such as a silicon-based material, by deforming a portion of the member which is mounted in the aperture of said part.

According to the invention, said member includes a radially flared portion that is elastically and plastically deformed so as to radially grip or clamp the wall of said part surrounding the aperture, by stressing the elastic deformation means thereof, in order to secure the assembly in a manner that is not destructive for said part.

Moreover, in a preferred manner, the shape of the radially flared portion of the member present in the aperture substantially matches the aperture in the part, so as to exert a substantially uniform radial stress on the wall of the part surrounding said aperture. Indeed, when research was carried out, it was clear that it was preferable for the flared portion of the member present in the aperture to uniformly distribute the radial stresses induced by its deformation on the wall of the part surrounding the aperture.

Consequently, if the aperture in the fragile part is circular, it is preferable for the external wall of the flared portion of the member present in the aperture to be substantially in the shape of a continuous cylinder, i.e. with no radial slot or axial pierced hole, to prevent any localised stresses on a weak portion of the wall of the part surrounding the aperture, which could start to cause breaking points.

Of course, the shape of the aperture in the fragile part may differ, for example by being asymmetrical, to prevent any relative movements between the elements of the assembly. This asymmetrical aperture may therefore be, for example, substantially elliptical.

This interpretation also justifies not using a washer on the top or bottom part of the flared portion of the member present in the aperture. Indeed, during the deformation, this type of washer would transmit part of the axial deformation force onto the top (or the bottom) of the fragile part. Hence, the shearing exerted, in particular, by the edges of the washer on the top (or bottom) of the fragile part similarly generates localised stresses that could cause breaking points.

Consequently, if the section of the aperture is circular, the flared portion of the member present in the aperture (the shape of which matches the aperture) may be interpreted as an unbroken disc with continuous external walls, i.e. without any grooves or more generally any discontinuity of material. Thus, via elastic and plastic deformation, the matching shape of the flared portion of the member present in the aperture therefore enables a substantially uniform radial stress to be generated over a maximised surface area of the wall of the part around the aperture.

Finally, according to the invention, the part includes pierced holes forming elastic deformation means, which is distributed around and at a distance from the aperture and which is intended to absorb said radial forces and to release them once the stress from the tools has been relaxed so as, eventually, to secure the assembly in a manner that is not destructive for said part.

Figure 2:
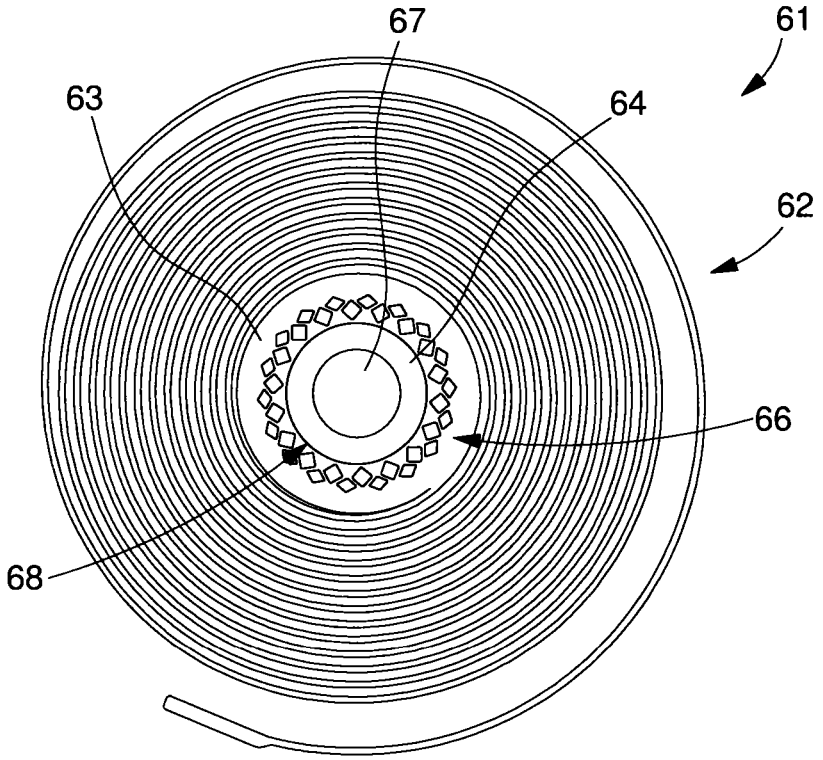
FIG. 2 is a partial, schematic view of a timepiece balance spring including a fourth assembly according to the invention.

The assembly according to the invention will be better understood with reference to FIGS. 1 to 8 showing example applications within the field of horology. FIG. 1 shows a timepiece escape system, including pallets 1 and an escape wheel 3 and FIG. 2 shows a balance spring 61.

In the case of FIG. 1, the pallets 1 for example include two assemblies 2, 12 according to the invention, respectively for securing the dart 7 and the member, which here is a pivot pin 17, with the lever 5 thereof. As seen in FIG. 1, each assembly 2, 12 includes a radially flared portion 4, 14, which is substantially disc-shaped and integral with dart 7 or member 17 and cooperates with lever 5 of pallets 1. Moreover, each assembly 2, 12 includes pierced holes 6, 16 which are made in lever 5 around an aperture 8, 18 and are intended to form elastic deformation means. It is thus clear that assembly 2, 12 is sufficiently resistant to avoid generating relative movements between its components.

The escape wheel 3, and more generally wheel set 3 includes, by way of example, an assembly 22 for securing the member, which here is pivot pin 27, to body 25 of wheel 3. As seen in FIG. 1, assembly 22 includes radially flared portion 24, which is substantially disc-shaped and integral with member 27 and cooperating with the body 25 of wheel 3. Moreover, assembly 22 includes pierced holes 26, which are made in the hub around an aperture 28 in wheel 3 and intended to form elastic deformation means.

It is thus immediately clear that the example assembly 22 can be applied to any type of wheel set. Further, in addition to flared portion 24, member 27 may comprise an integral pinion so as to form the finished wheel set.

Thus, as illustrated in FIG. 2, it is possible to fix a balance spring 61 to a member, which here is a balance staff 67, by using an assembly 62 according to the invention. Pierced holes 66 are formed in the collet 63 of balance spring 61 and disc-shaped portion 64, integral with member 67, is mounted in the aperture 68 in collet 63 in a similar manner to the explanation provided hereinbefore.

Examples of pierced holes are shown in FIGS. 3 to 8. According to a first embodiment illustrated in FIGS. 3 to 6, the pierced holes are formed at a distance from and around the aperture by two series of diamond-shaped holes distributed in a quincunx arrangement so as to form beams arranged in secant V-shapes.

Figure 3:
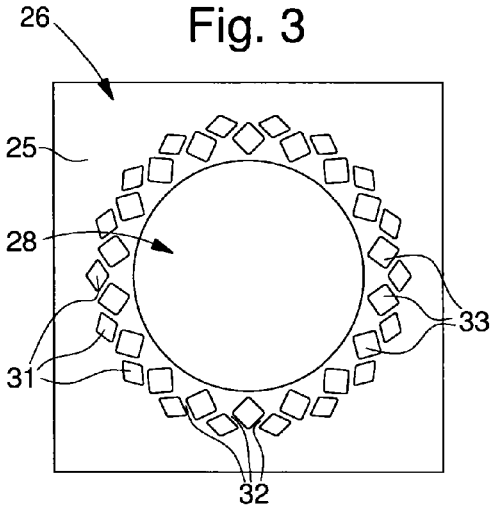
FIGS. 3 to 6 are views of variants of a first embodiment of elastic deformation means according to the invention.

FIG. 3 is a diagram of pierced holes 6, 16, 26, 66 of FIGS. 1 and 2. For more simplicity, only the wheel 3 references are used again in FIG. 3. FIG. 3 shows pierced holes 26, which preferably pass through the entire thickness of body 25, made of fragile material. Pierced holes 26 are distributed at a distance from and around aperture 28 which is also preferably formed to pass through the entire thickness of body 25 made of fragile material.

As seen in FIG. 3, pierced holes 26 form a first series of holes 31, the farthest from aperture 28, and a second series of holes 33, which are diamond-shaped and in a quincunx arrangement. FIG. 3 shows that pierced holes 31, 33 thus form V-shaped beams 32 which are secant to each other.

Figure 4:
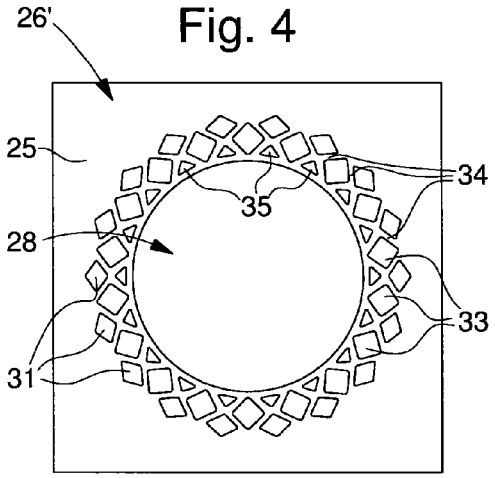

In a first variant of the first embodiment illustrated in FIG. 4, pierced holes 26' again comprise the first and second series of holes 31, 33 with the addition of a third series, which, formed of triangular holes 35, is located between the first two series and aperture 28, i.e. it is the closest to aperture 28. As seen in FIG. 4, the third series of holes 35 is distributed in a quincunx arrangement with one 33 of the first two series, so as to form X-shaped secant beams 34.

Figure 5:
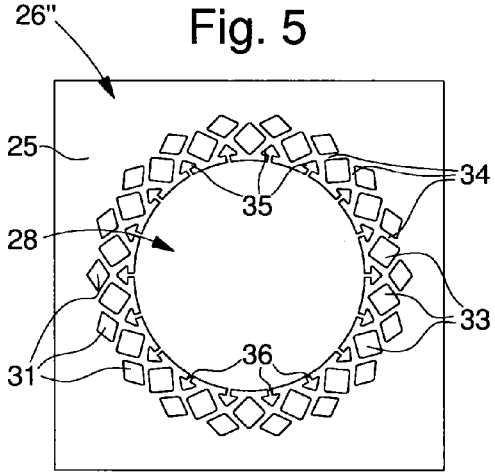

In a second variant of the first embodiment illustrated in FIG. 5, the pierced holes 26" again comprise the pierced holes 26' of FIG. 4 with the addition of slots 36, via which the third series of holes 35 communicate with aperture 28.

Advantageously, according to the invention, the series of holes 31, 33 and 35 and slots 36 are used to form elastic deformation means capable of absorbing radial stresses, i.e. forces exerted from the centre of aperture 28 towards the wall of body 25 surrounding said circular aperture.

Of course, the two or three series may be closer to or further from each other and/or of different shapes and/or different dimensions according to the maximum desired clearance and the desired stress for deforming beams 32, 34.

Figure 6:
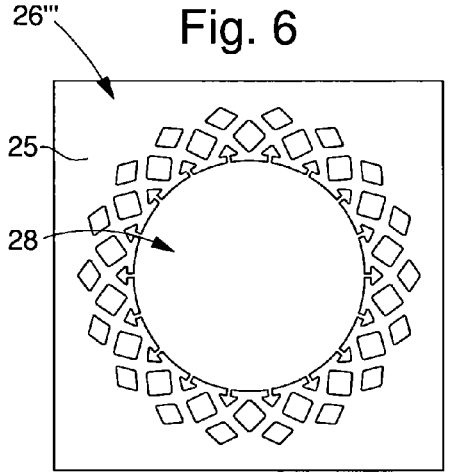

By way of example, an alternative to FIG. 5 is shown in FIG. 6. It can be seen that pierced holes 26'" are similar to those 26" of FIG. 5. However, the three series of holes are spaced further apart from each other. Further, it can be seen that the shapes and dimensions of both the holes and slots are different. It is thus clear that the alternative of FIG. 6 alters the rigidity of the elastic deformation means in the fragile material.

Preferably, pierced holes 26, 26', 26", 26'" extend over a width comprised between 100 μm and 500 μm from the wall of body 25 surrounding aperture 28. Further, slots 36 are comprised between 15 μm and 40 μm. Finally, the section of aperture 28 is preferably comprised between 0.5 and 2 mm.

Figure 7:
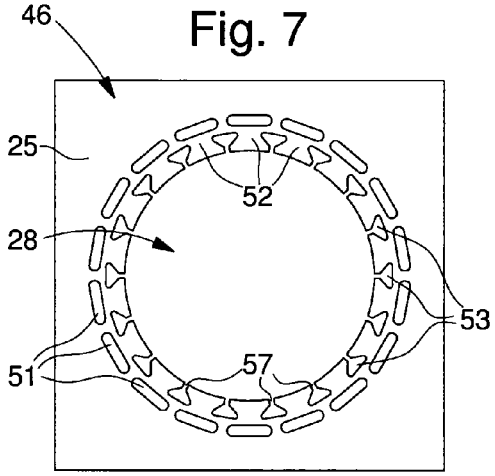
FIGS. 7 and 8 are views of variants of a second embodiment of elastic deformation means according to the invention.
Figure 8:
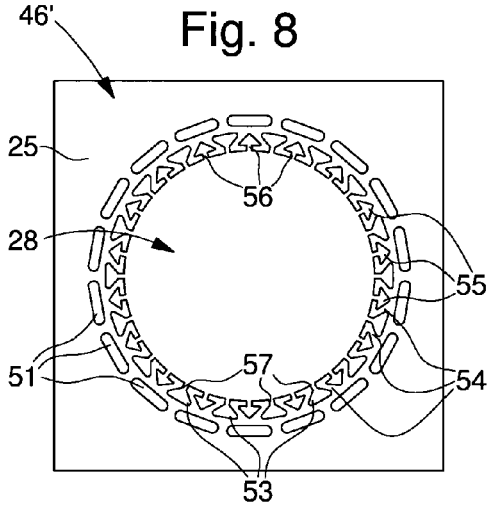

According to a second embodiment illustrated in FIGS. 7 and 8, the pierced holes are formed at a distance from and around the aperture by a first series of oblong holes distributed in a quincunx arrangement with a second series of triangular holes, the second series being closest to the circular aperture, each triangular hole communicating with the aperture via a notch so as to form beams that are radially moveable according to the thickness of the oblong holes.

Thus, FIG. 7 shows pierced holes 46 which preferably pass through the entire thickness of body 25, made of fragile material. Pierced holes 46 are distributed at a distance from and around aperture 28 which is also preferably formed to pass through the entire thickness of body 25 made of fragile material.

As seen in FIG. 7, pierced holes 46 form a first series of oblong holes 51 and a second series of triangular holes 53. According to the second embodiment, the two series of holes 51, 53 are arranged in a quincunx arrangement.

Further, each triangular hole 53 communicates with aperture 28 via a notch 57. FIG. 7 shows that pierced holes 46 thus form substantially trapezium shaped beams 52 which are separated from each other by notches 57. It is also noted that each beam 52 is centred on an oblong hole 51, which makes each beam 52 radially moveable according to the thickness of an oblong hole 51.

In a variant of the second embodiment illustrated in FIG. 8, pierced holes 46' again comprise the pierced holes 46 of FIG. 7, with the addition of a third series of triangular holes 55. Further, each hole 55 of the third series is arranged between two triangular holes 53 of the second series and communicates with aperture 28 via a slot 56. The pierced holes 46' thus form beams 54 with two independent symmetrical and substantially L-shaped arms, which are radially moveable according to the thickness of oblong holes 51 and tangentially according to the thickness of slots 56 and notches 57.

Of course, as in the first embodiment, the two or three series may be closer to or further from each other and/or of different shapes and/or of different dimensions according to the maximum desired clearance and the desired stress for deforming beams 52, 54.

Preferably, pierced holes 46, 46' extend over a width comprised between 100 μm and 500 μm from the wall of body 25 surrounding aperture 28. Further, slots 56 and notches 57 are comprised between 15 μm and 40 μm. Finally, the section of aperture 28 is preferably comprised between 0.5 and 2 mm.

Figure 9:
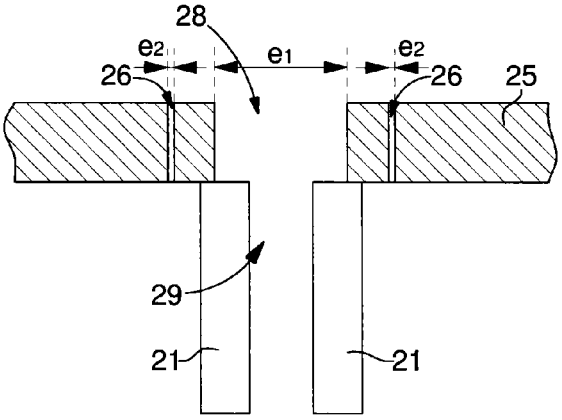
FIGS. 9 to 11 are schematic diagrams of successive steps of the assembly method according to the invention.

The method of assembly will now be explained with reference to the schematic FIGS. 9 to 11. For more simplicity, only the wheel 3 references are used again in FIGS. 9 to 11. According to the invention, a first step consists in forming part 3 from a material having no plastic domain, with an aperture 28 and pierced holes 26, which are distributed around aperture 28 and intended to form elastic deformation means, in accordance, for example, with the embodiments explained hereinbefore. As seen in FIG. 9, aperture 28 has a section $e_1$ and pierced holes 26 include holes of section $e_2$.

This step may be achieved by dry or wet etching, for example DRIE (deep reactive ionic etching).

Figure 10:
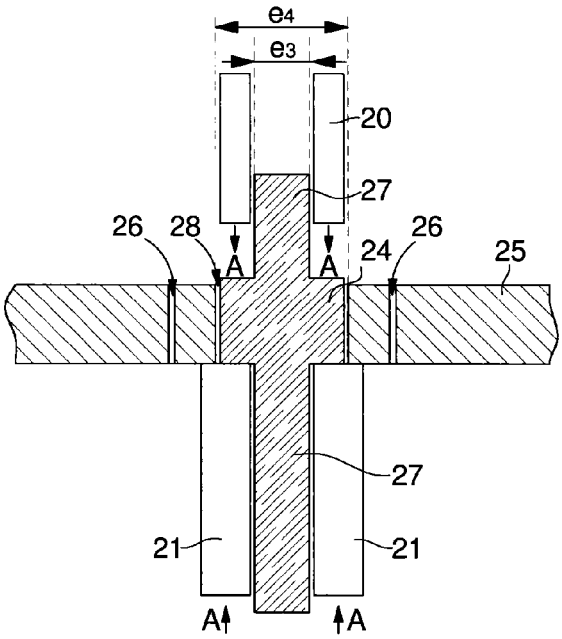
Figure 11:
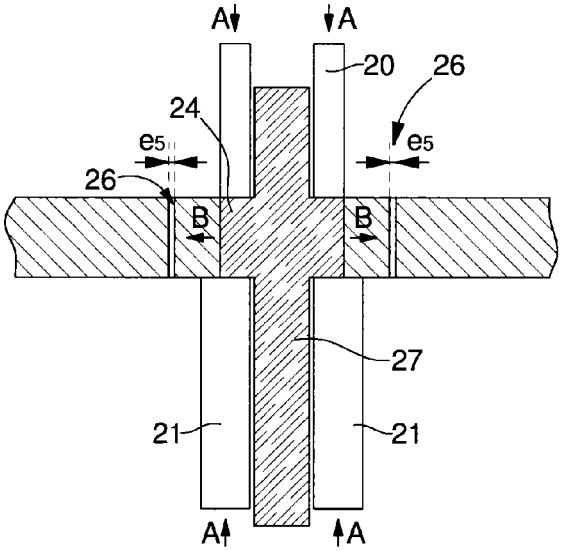

Further, in a second step, the method consists in forming the axially extending member, which is a pivot pin 27 in the example of FIGS. 9 to 11, in a second material with a main section $e_3$ and a radially flared portion 24, which is intended to be deformed, with a maximum section $e_4$. Portion 24 may have a thickness of between 100 and 300 μm. As explained hereinbefore, the second step can be carried out in accordance with usual arbour fabrication processes. Member 27 is preferably metal and may for example be formed of steel.

Of course, the first two steps do not have to observe any particular order and may even be performed at the same time.

In a third step, flared portion 24 is inserted into aperture 28 without any contact. This means, as seen in FIG. 10, that the section $e_1$ of aperture 28 is larger than or equal to the external section $e_4$ of flared portion 24 of member 27.

Preferably, the difference between the section $e_1$ of aperture 28 and the external section $e_4$ of flared portion 24 is approximately 10 μm, i.e. a gap of around 5 μm, which separates body 25 of part 3 relative to flared portion 24 of member 27.

Further, preferably, according to the invention, flared portion 24 and, incidentally, member 27, is held in aperture 28 via one 21 of the tools 20, 21 used for the deformation step. Finally, in a preferred manner, tool 21 includes a recess 29 for receiving a portion of member 27.

Finally, the method includes a fourth step, which consists in elastically and plastically deforming flared portion 24 of member 27 by moving tools 20, 21 towards each other in axial direction A, so as to exert a uniform radial stress B against the wall of the part 3 surrounding aperture 28 by stressing the elastic deformation means of part 3, i.e. pierced holes 26.

Thus, as seen in FIG. 11, the pressing on the top and bottom parts of deformed flared portion 24, respectively by tool 20 and 21, in the axial direction A, will induce an exclusively radial, elastic and plastic deformation of flared portion 24 in direction B, i.e. towards body 25.

Preferably according to the invention, the parameters of the deformation are set so that the clamping force is greater at the gap between the non-deformed flared portion 24 and the wall of body 25 surrounding aperture 28. Preferably, the clamping force generates a displacement which is comprised between 8 and 20 μm.

Consequently, the elastic and plastic deformation of flared portion 24 causes the elastic deformation of body 25 around aperture 28, so as to secure member 27, and thus its deformed flared portion 24, to body 25 of wheel 3, as seen in FIG. 11. This elastic deformation automatically centres the assembly comprising member 27-body 25. In this regard, FIG. 11 shows that the pierced holes 26 have a section referenced $e_5$ and no longer $e_2$.

Advantageously according to the invention, it is possible to secure member 27 from any side of body 25 of wheel 3. Further, no axial force (which by definition is likely to be destructive) is applied to body 25 of wheel 3 during the process. Only radial elastic deformation is applied to body 25. It is also to be noted that the use of the radially flared portion 24 preferably allows uniform stress to be exerted on a maximised surface area of the wall of body 25 around circular aperture 28, during the radial deformation B of flared portion 24, in order to avoid causing any breaking points in the fragile material of wheel 3 and to adapt to any dispersions in fabrication of the various components.

Of course, this invention is not limited to the illustrated example but is capable of various variants and alterations that will appear to those skilled in the art. In particular, the pierced holes of the part made of fragile material may include more or fewer series of holes than the embodiments presented hereinbefore. Moreover, the embodiments presented here may be combined with each other depending upon the intended application.

Radially flared portion 24 may also have a different geometry so as to optimise or "programme" the deformation towards body 25. For example, it is possible to envisage locally minimising or increasing the thickness of flared portion 24 so as to favour one sense of deformation relative to the other in direction B. By way of example, it is therefore possible to envisage making a conical recess coaxial to member 27, so as to facilitate radial orientation B, but also to make the induced stress progressive.

FIGS. 1 and 2 show applications for an escape system, such as pallets 1 and escape wheel 3, or a balance spring 61 of a timepiece movement. Of course, the present assembly 2, 12, 22, 62 may be applied to other elements. It is possible to envisage forming a balance, a bridge or, more generally, a mobile part using an assembly 2, 12, 22, 62 as explained above, but this is not an exhaustive list.

It is also possible to use the assembly 2, 12, 22, 62 in place of elastic means 48 or the cylinders 63, 66 of WO Patent No. 2009/115463 so as to fix a single-piece sprung balance resonator to a pivot pin.

Of course, two parts like those described hereinbefore may also be secured to the same arbour using two distinct assemblies 2, 12, 22, 62 so as to make their respective movements integral. It is clear that the same arbour will be formed with two radially flared portions 4, 14, 24, 64, which are intended to be deformed.

Finally, assembly 2, 12, 22, 62 according to the invention can also unite any type of timepiece or other member, whose body is formed of a material having no plastic domain (silicon, quartz, etc.) with an arbour, such as, for example, a tuning fork resonator or more generally a MEMS (Microelectromechanical system).

The invention claimed is:

1. A method of assembling an axially extending member made of a first material in a part made of a second material having no plastic domain, comprising:

a) forming the part with an aperture and pierced holes distributed around the aperture intended to form elastic deformation means;

b) inserting a radially flared portion of said member into the aperture without any stress;

c) elastically and plastically deforming the flared portion of said member in the aperture by moving two tools towards each other axially, respectively on top and bottom parts of said flared portion, so as to exert a radial stress against the wall of the part surrounding the aperture, by stressing said elastic deformation means of the part, in order to secure the assembly in a manner that is not destructive for said part.

2. The method according to claim 1, wherein a shape of an external wall of the flared portion of said member substantially matches the aperture of the part, so as to exert a substantially uniform radial stress on the wall of the part surrounding the aperture.

3. The method according to claim 1, wherein the aperture of the part is circular.

4. The method according to claim 1, wherein the aperture of the part is asymmetrical to prevent any relative movement between elements of said assembly.

5. The assembly method according to claim 1, wherein, in b), the difference between the section of the circular aperture and the external section of the flared portion of said member in the aperture is approximately 10 μm.

6. The assembly method according to claim 1, wherein, in c), the deformation exerts a clamping force which generates a displacement comprised between 8 and 20 μm.

7. The assembly method according to claim 1, wherein, in b) and c), the flared portion of the member in the aperture is held in the aperture via one of the two tools.

8. The assembly method according to claim 1, wherein the second material is silicon-based.

9. The assembly method according to claim 1, wherein the first material is formed from a metal or metal alloy base.

10. The assembly method according to claim 1, wherein the part is a timepiece wheel set.

11. The assembly method according to claim 1, wherein the part is timepiece pallets.

12. The assembly method according to claim 1, wherein the part is a timepiece balance spring.

13. The assembly method according to claim 1, wherein the part is a resonator.

14. The assembly method according to claim 1, wherein the part is a MEMS.

* * * * *